United States Patent [19]

Yeatts

[11] 4,295,478

[45] Oct. 20, 1981

[54] COMPOSITE TIPPING STRUCTURE FOR USE ON AN AIR-VENTILATED CIGARETTE AND METHOD OF MANUFACTURING SAME

[75] Inventor: Roy E. Yeatts, Winston-Salem, N.C.

[73] Assignee: RJR Archer, Inc., Winston-Salem, N.C.

[21] Appl. No.: 29,163

[22] Filed: Apr. 11, 1979

[51] Int. Cl.[3] ..... A24C 5/56; A24D 3/00; A24D 3/18

[52] U.S. Cl. ..... 131/336; 219/383; 219/384

[58] Field of Search ..... 131/15 B, 15 R, 10 A, 131/8, 9, 23 R, 170 R, 68; 219/384, 383; 93/1 C, 77 FT

[56] References Cited

U.S. PATENT DOCUMENTS

| | | | |
|---|---|---|---|
| 1,790,452 | 1/1931 | Wilsey | 175/265 |
| 2,141,869 | 12/1938 | Konig | 175/265 |
| 2,372,508 | 3/1945 | Meaker | 175/265 |
| 2,385,246 | 9/1945 | Wilsey | 175/265 |
| 2,550,366 | 4/1951 | Meaker | 219/384 |
| 2,647,065 | 7/1953 | Scholl | 117/4 |
| 2,861,006 | 11/1958 | Salditt | 117/7 |
| 2,980,116 | 4/1961 | Schur | 131/9 |
| 2,988,088 | 6/1961 | Schur | 131/9 |
| 3,020,915 | 2/1962 | Miller | 131/9 |
| 3,046,994 | 7/1962 | Schur | 131/10 |
| 3,054,409 | 9/1962 | Miller | 131/9 |
| 3,088,843 | 5/1963 | Schaar | 117/10 |
| 3,098,143 | 7/1963 | Warmt | 219/99 |
| 3,167,641 | 1/1965 | Parmele et al. | 219/384 |
| 3,183,518 | 5/1965 | Henry et al. | 346/76 |
| 3,247,747 | 4/1966 | Robbins | 83/629 |
| 3,348,022 | 10/1967 | Schirmer | 219/384 |
| 3,385,951 | 5/1968 | Bancroft et al. | 219/384 |
| 3,394,708 | 7/1968 | Grassi | 131/9 |
| 3,420,243 | 1/1969 | McArthur | 131/94 |
| 3,424,895 | 1/1969 | Olson | 219/384 |
| 3,426,761 | 2/1969 | Fernandez | 131/9 |
| 3,435,190 | 3/1969 | Schifmer | 219/384 |
| 3,475,591 | 10/1969 | Fujii et al. | 219/384 |
| 3,502,845 | 3/1970 | Schirmer | 219/384 |
| 3,503,406 | 3/1970 | Riegel et al. | 131/10 A |
| 3,512,537 | 5/1970 | Pelletier | 131/10 A |
| 3,538,308 | 11/1970 | Schmidt | 219/384 |
| 3,596,663 | 8/1971 | Schultz | 131/10 A |
| 3,622,751 | 11/1971 | Larine | 219/384 |
| 3,701,353 | 10/1972 | Pasquine et al. | 131/23 R |
| 3,742,963 | 7/1973 | Greamer | 131/258 |
| 3,756,880 | 9/1973 | Graczyk | 756/73 |
| 3,778,328 | 12/1973 | Beard | 156/215 |
| 3,783,237 | 1/1974 | McArthur | 219/384 |
| 3,800,805 | 4/1974 | Horsewell et al. | 131/10.3 |
| 3,805,800 | 4/1974 | Summers | 131/10 A |
| 4,025,752 | 5/1977 | Whitson | 219/384 |
| 4,029,938 | 6/1977 | Martin | 219/384 |
| 4,035,220 | 7/1977 | Hammersmith | 131/10 A |
| 4,035,611 | 7/1977 | Martin et al. | 219/384 |
| 4,094,324 | 6/1978 | Bolsinger et al. | 131/15 B |
| 4,100,396 | 7/1978 | Martin | 219/384 |
| 4,174,719 | 11/1979 | Martin et al. | 131/10 A |

FOREIGN PATENT DOCUMENTS

| | | | |
|---|---|---|---|
| 1037814 | 9/1978 | Canada | 131/10A |
| 1163216 | 2/1964 | Fed. Rep. of Germany | 131/170 R |
| 2220165 | 11/1972 | Fed. Rep. of Germany | 131/15 B |
| 2362319 | 7/1974 | Fed. Rep. of Germany | 131/15 B |
| 2613304 | 10/1977 | Fed. Rep. of Germany | 131/170 R |
| 2817390 | 10/1978 | Fed. Rep. of Germany | 219/384 |
| 2206663 | 11/1974 | France | 131/10 A |
| 710168 | 3/1972 | South Africa | 131/15 R |
| 766116 | 10/1976 | South Africa | 131/15 R |
| 938902 | 10/1963 | United Kingdom | 131/10 A |
| 1339238 | 11/1973 | United Kingdom | 131/115 B |
| 1372730 | 11/1974 | United Kingdom | 131/68 |
| 1531464 | 11/1978 | United Kingdom | 131/10 A |

*Primary Examiner*—V. Millin

*Attorney, Agent, or Firm*—Grover M. Myers

[57] ABSTRACT

A composite structure for use on a smoking product including a non-porous tipping paper coated with a heat-activatable adhesive in a selected pattern, having areas void of adhesive and microscopic openings through the tipping paper within the void areas. The method of manufacturing the composite structure includes applying a non-conductive, heat-activatable adhesive coating on the paper web in a specific pattern having void and adhesive coated areas and forming perforations in the void areas of the paper web.

9 Claims, 9 Drawing Figures

COMPOSITE TIPPING STRUCTURE FOR USE ON AN AIR-VENTILATED CIGARETTE AND METHOD OF MANUFACTURING SAME

TECHNICAL FIELD

This invention relates to a ventilated filter cigarette tipping paper and method of manufacturing the same.

BACKGROUND OF THE INVENTION

The mixing of air with smoke in a tobacco product has been utilized for many years to produce a milder smoking product. The first air diluted smoking product was probably made by the smoker. For instance, for many years cigar smokers have manually pierced holes in the cigar wrapper leaf prior to lighting the cigar in order to permit air to be drawn into the body of the cigar during smoking. This air dilution produced a milder smoke. When the cigarette was first developed, there was no need for air dilution because cigarette smoke was much milder than the cigar smoke. As time passed, however, smokers tended to prefer milder smoking cigarettes.

Various methods have been used to produce milder smoking cigarettes; for example, toasting the tobacco, utilizing filters of different materials, such as paper, cellulose acetate, charcoal, etc., tobacco and filter additives and tobacco substitutes. Nevertheless, the most widely used and important method of producing a milder cigarette is air dilution. Initially, the cigarette paper (tobacco rod wrapper) itself was perforated to introduce air into the tobacco rod during smoking similarly to piercing the cigar wrapper leaf. Again, this was initially done manually by the smoker. Later, the cigarette paper was perforated prior to applying it to the tobacco rod, either through mechanical perforating means or electrostatic perforating means. Electrostatic perforating was preferred since the holes were microscopic in size and, therefore, invisible. Another method of introducing air into the tobacco rod was through the use of "porous" paper. A special paper making process is used to produce a uniform porosity in the cigarette paper by forming microscopic pores or openings in the paper to permit the passage of air.

As the smoker's preference continues to change, further efforts are being made to produce a milder smoking cigarette and to reduce the particulate matter and nicotine in the smoke. Filtration of the smoke utilizing various types of filter material and filter configurations in conjunction with air dilution has become the preferred method of reducing particulate matter and nicotine in the cigarette smoke. Air dilution is normally accomplished in two ways. First, by admixing the air and smoke within the filter element and, secondly, by preventing the admixing of the air and smoke until they reach the smoker's mouth. The primary filtration material used today is cellulose acetate fibers which are formed into cylindrical rods. The most widely used air dilution system is to admix the air and smoke within the filter prior to entering the smoker's mouth.

Numerous kinds of filter devices have been developed to permit admixing of air and smoke within the filter. The most prominent method is to form a filter plug making a rod of cellulose acetate fibers and wrapped in a "porous" plugwrap. The filter plug is then attached to a tobacco rod by a tipping paper which has a series of mechanical perforated holes. Another method which has been developed utilizes a porous tipping paper rather than a perforated tipping paper over the filter plug having a porous plugwrap.

The porous plugwrap is usually wrapped around the cellulose acetate rod and glued along a longitudinal edge; therefore, there is only a single longitudinal strip of adhesive along the edge to prevent the passage of air into the cellulose acetate rod. The filter plugs are attached to the tobacco rod by the tipping paper and use various gluing techniques to prevent the adhesive from covering the entire tipping paper, which would prevent the passage of air.

U.S. Pat. No. 3,805,800, for example, discloses one method of applying a wet glue pattern to a porous tipping paper. As can be seen, a checker-board pattern, circumferential strips, or longitudinal lines of glue can be used so that large areas of the tipping paper remain free of adhesive to insure a sufficient amount of air can pass into the filter.

U.S. Pat. No. 4,035,220 discloses a method which is called "laking". In this method, a wet glue is applied to the tipping and, because of the phenomena called "laking," which occurs when two objects which are not totally wetted are adhered together, the adhesive forms beads or collects in small defined areas, thus, producing void areas through which air can be drawn.

It can be readily seen, in either of these patents, that the tipping has large areas void of adhesive and, thus, the porosity of the tipping can be maintained at a selected level. Should either of these methods be used, an additional gluing step is required to insure that the adhesive-free edge of the tipping gear is glued down. If this edge is not glued down, the air dilution of each product can vary and the uniformity of air dilution which is required cannot be obtained.

Another problem results when using a wet adhesive and porous tipping together. Porous tipping must be very thin to obtain the desired porosity. Because of this thinness, the tensil strength of the paper is low, and there is a tendency for the paper to break under production conditions. When the porous tipping is wetted with an adhesive, the tensil strength is further reduced and breakages occur more frequently, particularly if the pattern of adhesive is transverse to the direction of movement of the tipping paper. Also, when using a wet adhesive on a porous paper, there is a tendency for the glue to bleed through the pores in the paper so that glue gets on the outside of the filter paper which is not acceptable from an appearance standpoint; and, also, if the glue gets on the outside of the filter paper, it is transferred to the machine parts where it builds up and reduces the efficiency of the machine.

Because of the numerous problems which occur when using porous tipping, most air ventilated cigarettes use tipping which has been perforated by mechanical means (i.e., needles). Although mechanically perforated tipping is the most widely used, it does have some drawbacks. One drawback is the size of the holes. No matter what type of mechanical device is used, the holes formed are macroscopic in size and can be seen. From a marketing point of view, this is undesirable. For this reason, most of the air diluted cigarettes utilize a white tipping paper which has been mechanically perforated. If mechanically perforated imitation cork tipping is used, the perforations can easily be seen because of the contrast produced by the white plugwrap being exposed through the holes. Thus, if imitation cork tipping is to be used, it is preferable to have microscopic holes which cannot be seen.

Although microscopic holes can be made electrostatically and this method has been used in the tobacco industry for many years in cigarette paper, it has been only recently that electrostatically perforated tipping has been developed to such an extent where it might possibly be used on tipping paper. There were a number of reasons for the slow development of the electrostatic perforated tipping; for example, the thickness of the tipping paper required that more voltage be used which produces scorching of the paper, thus, making the machine design more difficult. Also, there was great difficulty in controlling the location and size of the holes. As can be easily understood, the size and number of holes must be controlled within a given range or the porosity of the tipping will vary too greatly to give the uniformity of air dilution which is required. Furthermore, locating the holes in a specific area (i.e., circumferential band) is important because of the gluing requirement. Although recent developments in electrostatically perforating techniques have overcome some of the problems with respect to size, number and location of holes, other problems must be overcome before electrostatically perforated tipping paper could efficiently be used on a tobacco product.

For example, the principal problem with electrostatically perforation is the width of the circumferential bands of perforations which must be used to insure the proper porosity of the paper. Using presently known gluing techniques, a substantial portion of the edge of the tipping must remain unglued, thus, providing a possibility of non-uniform air dilution between products. The only known way to overcome this problem at the present time is to add a gluing device to the machine which will glue the edge down.

There also exists some device in which a heat-activatable adhesive can be used on the tipping paper. The heat-activatable adhesive is pre-coated on the tipping prior to being used on the filter cigarette assembly machine. A device such as the one disclosed in U.S. Pat. No. 3,420,243 to McArthur can be used to attach the pre-coated tipping to the cigarettes. However, the basic problem encountered with the wet glue techniques would also be encountered with the heat-activatable adhesive.

Because of these difficulties, there exists a need for a ventilated tipping paper in which the porosity can be controlled and the tipping would adhere to the filter plug without leaving wide gaps along its edge. There also exists a need for a method of making such tipping paper which can be used with either white or imitation cork tipping.

SUMMARY OF THE INVENTION

It is, therefore, an object of this invention to provide a ventilated tipping paper in which the porosity can be controlled.

Another object of this invention is to provide a ventilated tipping paper which will adhere to the filter plug without leaving large areas free of adhesive, particularly along the edge of the tipping.

Another object of this invention is to provide a pre-coated heat-activatable electrostatically perforated tipping paper.

Still another object of this invention is to provide a method of manufacturing a pre-coated heat-activatable electrostatically perforated tipping paper.

These and other objects are accomplished by the present invention through the use of a composite structure including a web of non-porous tipping paper coated with a heat-activatable adhesive in a selected pattern having a zone with a plurality of intermingled discrete coated and void (uncoated) areas, said tipping paper having microscopic openings interspersed within the adhesive void areas of said pattern. Adhesive is applied to the paper web by a gravure or slot-coating method and perforations are formed by an electrostatic perforating means.

DESCRIPTION OF A PREFERRED EMBODIMENT

Figure 1:
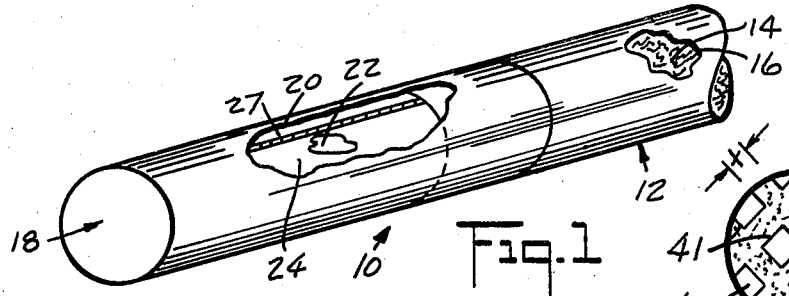
FIG. 1 is a perspective of a filter cigarette utilizing a perforated tipping paper having a patterned heat-activatable adhesive coating.

In FIG. 1, the numeral 10 indicates a smoking product and, in particular, a filter cigarette. The filter cigarette includes a tobacco rod 12 and a filter element 18. The tobacco rod is composed of a blend of tobacco 14 encapsulated in a paper tube or sleeve 16, and the filter element 18 includes a filter plug attached to the tobacco rod 12 by a tipping paper 20. The filter plug is preferably formed of a cellulose acetate fiber or tow which is made into a rod 22 and overwrapped by a porous paper web 24. Any type of porous web 24 can be used, but, in general, a web having a range of porosity of between 0.09 sec. Gurley to 3.0 sec. Gurley is ideally suited for this purpose.

For example, porous plugwrap manufactured by Ecusta Paper Co. of Pisgah Forest, N.C. can be used. The table below illustrates three examples of Ecusta porous plugwrap showing a range of porosity and optium porosity values.

| Ecusta I.D. No. | Range | Optium |
|---|---|---|
| 626 | 0.3–0.5 | 0.3 |
| 612 | 0.6–1.1 | 0.6 |
| 592 | 1.0–3.0 | 3.0 |

Porosity values are in sec. Gurley units which is a standard unit of measure for porosity (1 sec. Gurley equals seconds required for 100 ml. of air to flow through 1 sq. in.).

Another example of a porous plugwrap is manufactured by Schweitzer Paper Co., Newark, N.J. and is identified by No. U1967. This plugwrap has a porosity approximate range of 0.03–0.09 sec. Gurley with an optium range of 0.06 sec. Gurley.

The porous plugwrap 24 is sealed along a longitudinal strip 27 in a normal manner so that the major portion of the surface of the plugwrap will permit air to pass into the cellulose acetate rod 22. There are other types of filter plugs which are known in the art that do not use overwrap; these types of filter plugs can also be used with this invention.

Figure 3:
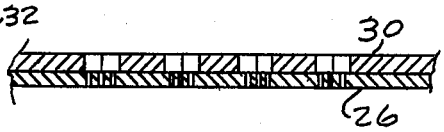
FIG. 3 is a cross-section taken along Line 3—3 of FIG. 2.

The tipping material or paper 20 of the present invention is a composite structure having a nonporous paper web 26 and a heat-activatable adhesive coating 30 (see FIG. 3) in a pattern having a zone with a plurality of intermingled discrete coated and void areas. The paper will generally be a standard non-porous tipping paper, known in the art, and can be either white or can be printed in an imitation cork color. Normally the porosity of non-porous tipping paper is specified at a minimum value of about 1,000 sec. Gurley.

Figure 2A:
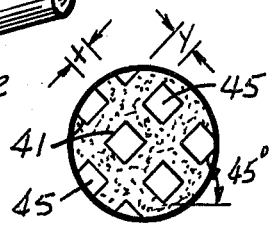
FIG. 2A is an exploded detail of a portion of the intermediate band shown in the embodiment of FIG. 2.
Figure 2:
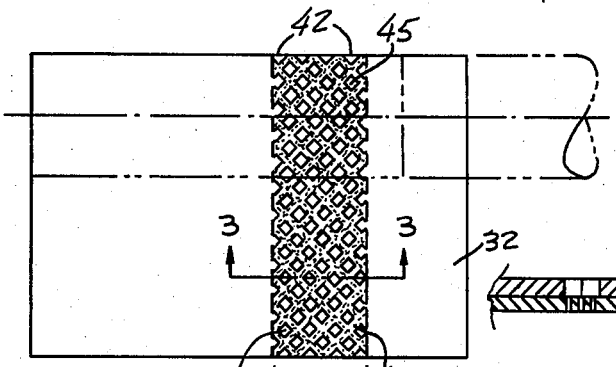
FIG. 2 is a plan view of a perforated tipping illustrating one embodiment of the pattern of the heat-activatable adhesive coating.
Figure 4:
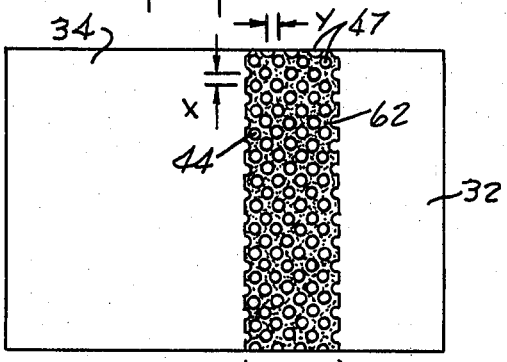
FIG. 4 is a plan view of a perforated tipping illustrating a second embodiment having a second pattern of a heat-activatable adhesive coating.
Figure 5:
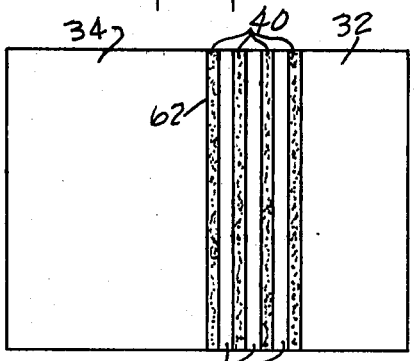
FIG. 5 is a plan view of a perforated tipping illustrating a third embodiment having a third pattern of a heat-activatable adhesive coating.

As can be seen in FIGS. 2, 4 and 5, preferably heat-activatable adhesive coating 30 is arranged in patterns having marginal bands 32 and 34. The band 32 provides adhesive to connect the tobacco rod and the filter plug while the band 34 seals the tipping to the mouth of the filter. A zone 36 in FIG. 2 and 38 in FIG. 4 is provided between the marginal bands. In FIG. 5, a plurality of adhesive-free strips or void areas 40 are disposed in the zone between the marginal bands 32 and 34. The strips 40 shown in FIG. 5 are separated by discrete adhesive bands 43.

Zone 36, has a plurality of intermingled, discrete coated and void areas. As can be seen in FIG. 2, there are rows 42 of diamond-shaped adhesive areas 45 wherein the points 41 of the diamonds overlap one another, as can be more clearly seen in FIG. 2A. In this embodiment, the intermediate band can be between 8–19 mm. in width but preferably about 8 mm. Each of the diamond-shaped areas is preferably 1 mm. square and they are spaced approximately 0.5 mm. apart in both directions x and y and are on a 45° angle to the end edges of the tipping. In a band of approximately 19 mm., the diamond-shaped areas can remain 1 mm. square and overlap in one direction while being spaced apart approximately 2 mm. in the other direction.

The second embodiment of the pattern application adhesive is illustrated in FIG. 4. Intermediate band 38 can be between 8–19 mm. in width and has a plurality of rows 47 of circular-shaped areas or dots 44. Preferably, the rows are spaced so that the dots overlap or are at least tangential to one another in one direction.

In the illustrated embodiment, the dots are 1 mm. in diameter and the rows are spaced 1 mm. apart in the x direction and 2 mm. apart in the y direction.

The third embodiment illustrated in FIG. 5, has a plurality of adhesive bands 43 and adhesive-free areas or strips 40. The strips 40 are preferably between 1 mm. and 2.85 mm. in width and are spaced apart by adhesive bands 43 between 0.95 mm. and 1.33 mm. Preferably, there will be four (4) adhesive-free strips having a width of 1 mm. and spaced by adhesive bands of 1.33 mm.

There are a number of other embodiments which can be used, for example, changing the size of the diamond areas or dots, changing the configuration of the adhesive areas, elimination of the overlap between rows, etc.; however, the general principle of the pattern heat-activatable coating does not change.

Figure 6:
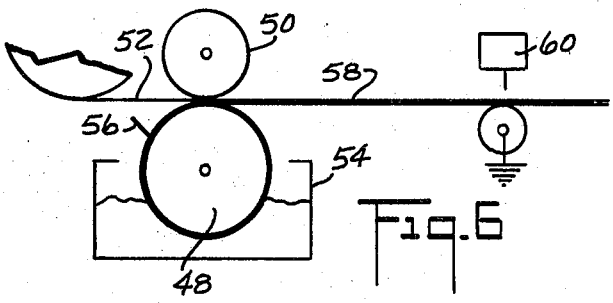
FIG. 6 is a side elevation view of one embodiment of an apparatus for producing said perforated tipping having a heat-activatable coating.

The heat-activatable coating can be applied to the paper web by a gravure printing method, though a Park-Slot coater, known in the art, can be used to establish the pattern shown in FIG. 5. In FIG. 6, an apparatus for manufacturing the pre-coated air ventilated tipping paper is illustrated. A gravure cylinder 48 is located below a pressure roll 50. The gravure cylinder is positioned in an adhesive reservoir 54 and, as a paper web 52 passes between the pressure roll and the gravure cylinder, adhesive is applied to the web. The adhesive is picked up by the cells of the gravure cylinder and a doctor blade 56 removes the excessive adhesive from the gravure cylinder before it contacts the paper web.

Figure 7:
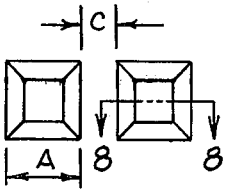
FIG. 7 is an exploded detail view of a portion of the gravure cylinder showing one of the cells on the cylinder.
Figure 8:
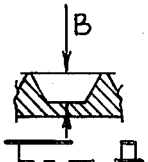
FIG. 8 is a cross-section taken along Line 8—8 of FIG. 7.

It has been found that the adhesive must have a high degree of hot tack, low viscosity and a low application temperature. Hot tack (i.e., 93° C.–205° C.) is that property of a material which permits it to stick to a given surface at elevated temperatures and form a bond with satisfactory strength. Hot tack usually increases as the molecular weight of a material and/or viscosity increases. The viscosity range should be between 1500 and 2000 Centipoise, and the application temperature range should be between 177° C. to 185° C. The adhesive should be odor and taste free as well as non-toxic and dielectric. There are a number of adhesives which might have all of these qualities but, in each situation, the type of adhesive to be used as well as its viscosity and the size of the gravure cylinder cells will depend primarily upon the temperature at which the coated tipping paper will be applied to the filter cigarette at the cigarette making machine. If the temperature of application is approximately 120°–135° C., a suitable heat-activatable adhesive is a modified ethylene vinyl acetate. The ethylene vinyl acetate is modified with wax to reduce viscosity and tack at room temperature, with synthetic resins to increase tack at sealing temperatures and with antioxidants to prevent degradation by oxidation. Such a modified EVA can be applied o the tipping at 177° C. by the use of a one-hundred-line screen etched gravure cylinder. The cylinder dimensions and the volume of each cell are inter-related to the viscosity of the resin and the type of pattern to be applied. Therefore, all variables must be carefully adjusted and matched to one another in order to obtain the patterns desired. The dimensions of a typical cell utilized with the above-mentioned modified EVA resin at an application temperature of 177° C. is illustrated in FIGS. 7 and 8 and in the table below.

| Cell Dimensions | Range (Microns) | Optium (Microns) |
|---|---|---|
| A (Width) | 205–215 | 210 |
| B (Depth) | 80–90 | 85 |
| C (Wall Thickness) | 15–20 | 18 |

Again, it should be understood that the type of adhesive, its viscosity and the method of application are all dependent upon the temperature at which the tipping gear is applied to the filter cigarette; therefore, if the temperature of application to the filter cigarette should vary from that suggested above, modification to the viscosity of the resin, size of the gravure cylinder cells and the method of application may also vary.

Turning again to the apparatus for manufacturing the pre-coated ventilated tipping, after the web 52 has been pattern-coated to form the composite structure 58, it passes through an electrostatic perforating or spark erosion device 60. Electrostatic perforating devices are known in the art and any such device can be used as long as the device can concentrate the perforations within the approximate specified width. The perforations 62 are only formed in the void or adhesive-free areas because of the dielectric character of the adhesive. The electrical charge will seek the path of least resistance which, of course, will be through the adhesive-free area. Although it would be possible to pierce a paper web completely coated with a uniform layer of film with a spark erosion device, the film would be momentarily softened and form in a conical shape. When coating is activated upon the application of the tipping to the cigarette, the adhesive will flow back over the opening in the tipping paper, thus, preventing air dilution of the cigarette smoke. The perforations which will be interspersed within the zones will be random in shape and location and microscopic in size. The porosity of the tipping can be varied depending upon the capability of the electrostatic perforating device. Generally, however, a porosity of between 1 sec. to 120 sec. Gurley can be obtained.

One of the important features of the patterns illustrated in FIGS. 2 and 4 are the adhesive areas which are interspaced between the marginal bands 32 and 34 of the tipping paper. These adhesive areas permit the intermediate band width to be wider since only small gaps occur at the edges of the tipping so that the edges will be more securely glued when the tipping is applied to the filter cigarette. Therefore, any additional device or step in the gluing process presently being used can be eliminated.

It can be seen from the above description and drawings, that the above pre-coated patterned heat-activatable electrostatically perforated tipping paper provides a ventilated tipping paper in which the location of the perforations can be controlled and a desired porosity can be obtained. The tipping adheres to the filter plug without leaving large areas free of adhesive, particularly along its edges. The above invention also provides a pre-coated heat-activatable electrostatically perforated tipping paper and discloses a method and apparatus for manufacturing the same.

I claim:

1. A composite structure for use as a tipping material for an air-ventilated smoking product comprising a non-porous paper web, a heat activatable adhesive coating on said non-porous paper web in a pattern including a zone having a width corresponding to a fraction of the length of said non-porous paper web and intermediate two marginal areas, said zone having a plurality of intermingled discrete coated and void areas, and microscopic perforations interspersed only within the void areas in said zone.

2. The composite structure of claim 1, wherein said coated areas in said zone are a plurality of rows of diamond-shaped configurations which have an overlapping relationship in at least one direction.

3. The composite structure of claim 1, wherein said coated areas in said zone are a plurality of rows of circular-shaped configurations which have a tangential relationship in at least one direction.

4. The composite structure of claim 1, wherein said zone includes a plurality of void strips about 1 mm. to 3 mm. in width separated by a plurality of said coated areas about 0.9 mm. to 1.33 mm. in width.

5. The composite structure of claim 1, wherein said heat-activatable adhesive has a high degree of hot tack, low viscosity, low application temperature, odor-free and taste-free, non-toxic and dielectric.

6. The composite structure of claim 5, wherein said heat-activatable adhesive is a modified ethylene vinyl acetate.

7. The composite structure of claim 1 or 5, wherein said perforations are formed by a sparked erosion process.

8. A method of manufacturing a composite tipping structure for use on an air-ventilated smoking product comprising the steps of:

(a) providing a non-porous paper web;

(b) applying a non-conductive, heat-activatable adhesive coating to said paper web in a pattern having discrete coated and void areas said coated areas having a relatively higher dielectric strength than said void areas;

(c) subsequent to applying said coating, forming perforations in said void areas of the paper web by spark erosion.

9. A composite tipping material manufactured by the method of claim 8.

* * * * *